US011629503B2

(12) United States Patent
Maziarz

(10) Patent No.: US 11,629,503 B2
(45) Date of Patent: Apr. 18, 2023

(54) BEAD STOP FOR A WALL HAVING INTERIOR CEMENT BOARD LAYER

(71) Applicant: E-Z BEAD, LLC, Royersford, PA (US)

(72) Inventor: Jeffrey Maziarz, Royersford, PA (US)

(73) Assignee: E-Z BEAD, LLC, Royersford, PA (US)

( * ) Notice: Subject to any disclaimer, the term of this patent is extended or adjusted under 35 U.S.C. 154(b) by 0 days.

(21) Appl. No.: 17/208,954

(22) Filed: Mar. 22, 2021

(65) Prior Publication Data

US 2021/0207381 A1 Jul. 8, 2021

Related U.S. Application Data

(63) Continuation-in-part of application No. 16/751,006, filed on Jan. 23, 2020, now Pat. No. 11,180,922.

(60) Provisional application No. 62/947,885, filed on Dec. 13, 2019.

(51) Int. Cl.
*E04F 13/06* (2006.01)
*E06B 1/62* (2006.01)

(52) U.S. Cl.
CPC ..... *E04F 13/06* (2013.01); *E06B 1/62* (2013.01); *E06B 2001/624* (2013.01)

(58) Field of Classification Search
CPC ..... E04F 19/02; E04F 2013/065; E04F 13/06; E04F 13/068; E04C 2/044; E04B 1/765; E06B 1/62; E06B 2001/624
See application file for complete search history.

(56) References Cited

U.S. PATENT DOCUMENTS

| | | | |
|---|---|---|---|
| 517,701 | A | 4/1894 | Knower |
| 1,030,044 | A | 6/1912 | Whittbecker |
| 1,361,843 | A | 12/1920 | Flagge |
| 1,386,509 | A | 8/1921 | Kirmes |
| 1,673,971 | A | 6/1928 | Dowell |
| 1,679,914 | A | 8/1928 | Murray |
| 1,840,221 | A | 1/1932 | Bridges |
| 1,886,320 | A | 11/1932 | Waite |
| 1,956,809 | A | 5/1934 | Robertson |

(Continued)

FOREIGN PATENT DOCUMENTS

| | | | |
|---|---|---|---|
| DE | 2455775 | 8/1976 | ..... E04F 15/14 |
| DE | 2538412 | 3/1977 | ..... E04F 15/14 |

(Continued)

OTHER PUBLICATIONS

Notice of Allowance issued in U.S. Appl. No. 11/981,421, dated Sep. 8, 2010 (6 pgs).

(Continued)

*Primary Examiner* — Theodore V Adamos
(74) *Attorney, Agent, or Firm* — Hayes Soloway P.C.

(57) ABSTRACT

Methods, systems, and an apparatus for constructing a termination point in a wall are provided. A rigid, cured cement board is attached to exterior sheathing of the wall. A stop bead apparatus is attached to the rigid, cured cement board at a terminating location of the wall. An edge of a rigid, cured cement board is inserted into a gap formed between a base panel of the stop bead apparatus and the exterior sheathing. A finish layer is applied to an exterior surface of the cement board, whereby the finish layer covers the base panel of the stop bead apparatus.

13 Claims, 9 Drawing Sheets

(56) References Cited

U.S. PATENT DOCUMENTS 2,031,249 A 2/1936 Bowman
2,151,605 A 3/1939 Layering
2,189,216 A 2/1940 Mathias
2,198,084 A 4/1940 Jacobson
2,272,162 A 2/1942 Lackey
2,286,890 A 6/1942 Birt
2,405,844 A 8/1946 Mortenson
2,645,824 A 7/1953 Titsworth ..... E04B 1/7069
2,725,608 A 12/1955 Parslow
2,732,045 A 1/1956 Herlocker
2,742,120 A 4/1956 Rosebrook
2,845,666 A 8/1958 Knapp
RE24,658 E 6/1959 Hollister
2,904,992 A 9/1959 Cruser
2,953,835 A 9/1960 Armstrong
3,192,577 A 7/1965 Barr
3,201,908 A 8/1965 Arnold
3,213,577 A 10/1965 Levin
3,314,201 A 4/1967 Riegelman
3,319,384 A 5/1967 Berg
3,320,707 A 5/1967 Berg ..... E04D 3/366
3,343,323 A 9/1967 Mayfield ..... 545/254
3,344,720 A 10/1967 Hallock
3,349,519 A 10/1967 Nehlig
3,398,494 A 8/1968 Larson
3,421,267 A 1/1969 Reiff ..... E04D 13/1415
3,425,172 A 2/1969 Attaway ..... E04D 13/1415
3,486,283 A 12/1969 Arnett
3,509,674 A 5/1970 Birum, Jr.
3,512,318 A 5/1970 Turner
3,608,254 A 9/1971 Sklamberg
3,619,944 A 11/1971 Matvey
3,638,372 A 2/1972 Rosenthal ..... 52/97
3,667,174 A 6/1972 Arnett
3,670,470 A 6/1972 Thom ..... E04D 13/151
3,765,138 A 10/1973 Bentle
3,782,680 A 1/1974 Hopkins
3,813,180 A 5/1974 O'Brill
3,849,958 A 11/1974 Balzer ..... E04B 1/6804
3,871,787 A 3/1975 Stegmeier
3,922,826 A 12/1975 Molyneux
3,964,220 A 6/1976 Rutkowski
3,974,609 A 8/1976 Attaway ..... E04B 1/6804
4,038,791 A 8/1977 Atkinson
4,111,583 A 9/1978 Brady ..... E01D 19/06
4,271,650 A 6/1981 Lynn-Jones ..... E04B 1/6804
4,295,315 A 10/1981 Lynn-Jones ..... E04B 1/6804
4,359,847 A 11/1982 Schukolinski ..... E04B 1/6804
4,505,079 A 3/1985 Black
4,545,162 A 10/1985 Attaway
4,651,488 A 3/1987 Nicholas
4,663,883 A 5/1987 Hilliard
4,726,148 A 2/1988 Tix
4,763,455 A 8/1988 Schneller
4,774,795 A 10/1988 Braun
4,781,004 A 11/1988 Hartman
4,784,516 A 11/1988 Cox
4,785,601 A 11/1988 Tupman
4,829,731 A 5/1989 Schluter
4,833,851 A 5/1989 Ohmatsu ..... E04B 1/6804
4,841,704 A 6/1989 Jarrell
4,984,402 A 1/1991 Davies ..... 52/398
5,014,471 A 5/1991 Ballstadt
5,042,211 A 8/1991 Nestler
5,073,430 A 12/1991 Aidan
5,127,204 A 7/1992 Braun
5,181,357 A 1/1993 Pourtau
5,210,986 A 5/1993 Hagemeyer
5,222,343 A 6/1993 Anderson
5,230,738 A 7/1993 Wheeler
5,305,566 A 4/1994 Larkowski
5,313,755 A 5/1994 Koenig, Jr.
5,333,432 A 8/1994 Schluter
5,338,130 A 8/1994 Baerveldt
5,365,713 A 11/1994 Nicholas ..... E04B 1/681
5,384,996 A 1/1995 Nicholas ..... E04B 1/681
5,406,758 A 4/1995 Baum ..... 249/6
5,423,154 A 6/1995 Maylon
5,430,981 A 7/1995 Scott
5,450,699 A 9/1995 Lee
D364,233 S 11/1995 Caley
5,519,969 A 5/1996 Golba ..... 52/60
5,544,445 A 8/1996 Mantilla
5,551,201 A 9/1996 Anderson
5,560,166 A 10/1996 Burke ..... F16J 15/065
5,575,126 A 11/1996 Attaway ..... E04B 1/6804
5,579,623 A 12/1996 Stark
5,607,253 A 3/1997 Almstrom
5,671,571 A 9/1997 Braun
5,694,723 A 12/1997 Parker ..... E02D 27/32
5,699,638 A 12/1997 Maylon
5,761,866 A 6/1998 Maylon
5,790,671 A 8/1998 Cooper
5,791,111 A 8/1998 Beenders ..... E04B 1/6804
5,791,116 A 8/1998 Skintzis
5,836,135 A 11/1998 Hagan ..... E04B 1/762
5,937,600 A ‡ 8/1999 Larson ..... E04B 1/762 52/302.6
5,946,870 A 9/1999 Bifano et al. ..... 52/254
5,950,370 A 9/1999 Peck
5,970,671 A ‡ 10/1999 Bifano ..... E04B 1/765 428/603
6,018,924 A 2/2000 Tamlyn
6,052,959 A 4/2000 LaBrosse ..... E04B 1/7076
6,102,407 A 8/2000 Moriya et al.
6,119,416 A 9/2000 Larson
6,122,883 A 9/2000 Braun
6,131,352 A 10/2000 Barnes ..... E04B 1/948
6,223,486 B1 5/2001 Dunham
6,293,064 B1 ‡ 9/2001 Larson ..... E04B 1/762 52/209
6,298,609 B1 ‡ 10/2001 Bifano ..... E04B 1/765 52/101
6,308,475 B1 10/2001 Crish, II
6,322,045 B1 11/2001 Andros
6,338,229 B1 1/2002 Botzen
D456,528 S 4/2002 Maylon
6,367,210 B1 4/2002 Trundle
6,385,932 B1 5/2002 Melchiori ..... 52/302.3
6,410,118 B1 ‡ 6/2002 Reicherts ..... B32B 13/04 428/141
6,425,216 B1 7/2002 Gardner
6,470,638 B1 * 10/2002 Larson ..... E04B 1/765 52/302.1
6,490,831 B1 12/2002 Candusso
D471,991 S 3/2003 Maylon
6,527,467 B2 3/2003 Betts ..... E01D 19/065
6,598,360 B1 7/2003 Pratt ..... E02D 31/02
6,609,341 B2 8/2003 Maylon et al. ..... 52/367
6,631,595 B1 10/2003 Minter
6,698,144 B1 ‡ 3/2004 Larson ..... E04B 1/765 52/202
6,705,047 B2 3/2004 Yulkowski
6,745,531 B1 ‡ 6/2004 Egan ..... E04B 1/70 52/302.1
7,406,805 B1 8/2008 Larson
7,458,190 B2 12/2008 Isaac et al.
7,526,897 B2 5/2009 Collins
7,634,883 B1 12/2009 Larson
7,673,421 B2 ‡ 3/2010 Pilz ..... E02B 7/42 405/100
7,874,123 B2 1/2011 Maziarz
8,132,380 B2 3/2012 Wilkes, Jr.
8,561,367 B2 10/2013 Kelly ..... E04D 3/405
8,578,660 B2 11/2013 Nolan et al. ..... 52/62
8,615,944 B2 12/2013 Maziarz
8,646,235 B2 2/2014 Hilburn ..... E04B 1/948
8,919,062 B1 12/2014 Viness et al. ..... 52/302.3
9,062,453 B1 6/2015 Maziarz ..... E04B 1/68
9,238,897 B2 1/2016 Nolan et al. ..... E02D 31/02
9,279,247 B2 3/2016 Maziarz ..... E04F 1/66
D762,310 S 7/2016 Apanovich ..... D25/119
9,797,142 B1 10/2017 Sacks ..... E04F 13/04

(56) References Cited

U.S. PATENT DOCUMENTS

| | | | | |
|---|---|---|---|---|
| 10,196,812 | B1 | 2/2019 | Duffy et al. | |
| 10,358,814 | B2 | 7/2019 | Maziarz | E04F 13/04 |
| 10,494,818 | B2 | 12/2019 | Maziarz | E04F 13/04 |
| 10,648,184 | B2 ‡ | 5/2020 | Maziarz | E04F 19/06 |
| 11,091,921 | B2 ‡ | 8/2021 | Maziarz | E04F 19/06 |
| 2002/0124504 | A1 | 9/2002 | Maylon | |
| 2003/0051422 | A1 | 3/2003 | Maziarz | |
| 2003/0221388 | A1* | 12/2003 | Benedettini | E04F 19/061 52/716.1 |
| 2004/0020143 | A1 | 2/2004 | Webb | |
| 2004/0216414 | A1 | 11/2004 | Dickinson | 52/506.01 |
| 2005/0204653 | A1 | 9/2005 | Matthews | E02D 31/02 |
| 2006/0005472 | A1 | 1/2006 | Miller | E06B 7/18 |
| 2006/0150553 | A1 | 7/2006 | Reyes | E04F 13/06 |
| 2006/0277854 | A1* | 12/2006 | Egan | E04B 1/70 52/302.3 |
| 2007/0062137 | A1 | 3/2007 | Maylon | 52/367 |
| 2008/0104918 | A1* | 5/2008 | Gleeson | E04F 13/08 52/489.1 |
| 2008/0263971 | A1 ‡ | 10/2008 | Maziarz | E04B 1/66 52/204.1 |
| 2009/0183453 | A1 | 7/2009 | Koessler | 52/302.3 |
| 2010/0257799 | A1 | 10/2010 | Johnson | E04F 13/0864 |
| 2011/0277394 | A1 | 11/2011 | Chich et al. | 52/95 |
| 2012/0174495 | A1 | 7/2012 | Nolan | E04F 19/045 |
| 2012/0324814 | A1 ‡ | 12/2012 | Amend | E04B 1/7645 52/302.1 |
| 2013/0205696 | A1* | 8/2013 | Little | E04F 13/072 52/255 |
| 2014/0245676 | A1 | 9/2014 | Maziarz | E06B 1/62 |
| 2016/0069071 | A1* | 3/2016 | Remmele | E04B 1/765 52/302.1 |
| 2016/0186481 | A1 | 6/2016 | Maziarz | E06B 1/02 |
| 2017/0130462 | A1 | 5/2017 | Maziarz | E04F 13/06 |
| 2017/0254091 | A1 ‡ | 9/2017 | Friel | E04B 1/765 |
| 2017/0342709 | A1 ‡ | 11/2017 | Dahlin | E04B 1/64 |
| 2018/0112414 | A1 ‡ | 4/2018 | Maziarz | E06B 1/62 |
| 2019/0161960 | A1 | 5/2019 | Blatz, Jr. et al. | E04B 1/7076 |
| 2019/0186147 | A1 | 6/2019 | Blatz, Jr. et al. | E04D 13/158 |
| 2019/0194954 | A1 | 6/2019 | Baltz, Jr. et al. | E04F 19/04 |
| 2020/0240153 | A1 ‡ | 7/2020 | Maziarz | E04F 19/061 |

FOREIGN PATENT DOCUMENTS

| | | | |
|---|---|---|---|
| DE | 3503395 | 8/1986 | E04B 1/68 |
| FR | 2307091 | 11/1976 | |
| FR | 2412236 | 7/1979 | |
| FR | 2507227 | 12/1982 | E04B 1/68 |
| SU | 1705521 | 1/1992 | |
| WO | WO-2009000437 A1 * | 12/2008 | E04F 13/06 |

OTHER PUBLICATIONS

Notice of Allowance issued in U.S. Appl. No. 12/152,046, dated Feb. 12, 2014 (16 pgs).
Notice of Allowance issued in U.S. Appl. No. 12/931,079, dated Aug. 21, 2013 (11 pgs).
Notice of Allowance issued in U.S. Appl. No. 14/275,757, dated Jan. 29, 2016 (5 pgs).
Notice of Allowance issued in U.S. Appl. No. 15/865,952, dated May 30, 2019 (4 pgs).
Notice of Allowance issued in U.S. Appl. No. 15/791,246, dated Oct. 25, 2019 (15 pgs).
Notice of Allowance issued in U.S. Appl. No. 16/137,340, dated Jan. 14, 2020 (14 pgs).
Notice of Allowance issued in U.S. Appl. No. 16/848,622, dated Apr. 21, 2021 (16 pgs).
Notice of Allowance issued in Canadian application No. 2,983,532, 1 pg.
Office Action issued in U.S. Appl. No. 09/952,920, dated Jan. 22, 2003 (12 pgs).
Office Action issued in U.S. Appl. No. 09/952,920, dated Jan. 26, 2005 (9 pgs).
Office Action issued in U.S. Appl. No. 09/952,920, dated Jun. 22, 2004 (6 pgs).
Office Action issued in U.S. Appl. No. 09/952,920, dated Oct. 22, 2003 (7 pgs).
Office Action issued in U.S. Appl. No. 11/259,499, dated Aug. 28, 2008 (9 pgs).
Office Action issued in U.S. Appl. No. 11/259,499, dated Oct. 23, 2007 (6 pgs).
Office Action issued in U.S. Appl. No. 11/259,499, dated Sep. 7, 2006 (9 pgs).
Office Action issued in U.S. Appl. No. 11/981,421, dated Aug. 5, 2009 (6 pgs).
Office Action issued in U.S. Appl. No. 12/152,046, dated Feb. 28, 2011 (7 pgs).
Office Action issued in U.S. Appl. No. 12/152,046, dated Nov. 30, 2011 (6 pgs).
Office Action issued in U.S. Appl. No. 12/152,046, dated Nov. 2, 2012 (28 pgs).
Office Action issued in U.S. Appl. No. 12/931,079, dated Oct. 15, 2012 (29 pgs).
Office Action issued in U.S. Appl. No. 12/931,079, dated Sep. 23, 2011 (11 pgs).
Office Action issued in U.S. Appl. No. 14/275,721, dated Jul. 13, 2015 (8 pgs).
Office Action issued in U.S. Appl. No. 14/275,721, dated Sep. 29, 2014 (9 pgs).
Office Action issued in U.S. Appl. No. 14/275,757, dated Jul. 14, 2015 (8 pgs).
Office Action issued in U.S. Appl. No. 14/275,757, dated Sep. 29, 2014 (9 pgs).
Office Action issued in U.S. Appl. No. 15/062,876, dated Oct. 19, 2016 (17 pgs).
Office Action issued in U.S. Appl. No. 15/791,246, dated Apr. 16, 2018 (6 pgs).
Office Action issued in U.S. Appl. No. 15/791,246, dated Dec. 12, 2018 (20 pages).
Office Action issued in U.S. Appl. No. 15/791,246, dated Jul. 26, 2018 (26 pgs).
Office Action issued in U.S. Appl. No. 15/791,246, dated Jul. 3, 2019 (27 pgs).
Office Action issued in U.S. Appl. No. 15/865,952, dated Mar. 1, 2019 (8 pgs).
Office Action issued in U.S. Appl. No. 15/865,952, dated Oct. 11, 2018 (10 pgs).
Office Action issued in U.S. Appl. No. 16/137,340, dated Aug. 6, 2019 (35 pgs).
Office Action issued in U.S. Appl. No. 16/751,006, dated Feb. 2, 2021, 45 pgs.
Office Action issued in U.S. Appl. No. 16/848,622, dated Mar. 12, 2021, 22 pgs.
Office Action issued in U.S. Appl. No. 14/869,524, undated, 11 pages, 2016.
Office Action issued in Canadian application No. 2,983,532 dated Aug. 25, 2020 (3 pgs).
U.S. Appl. No. 16/751,006, filed Jan. 23, 2020.
U.S. Appl. No. 16/848,622, filed Apr. 14, 2020, Maziarz.
U.S. Appl. No. 16/751,006, filed Jan. 30, 2020, Maziarz.
Office Action issued in U.S. Appl. No. 16/751,006, dated Jun. 25, 2021, 29 pgs.
Notice of Allowance issued in U.S. Appl. No. 16/751,006, dated Sep. 9, 2021, 13 pgs.
U.S. Appl. No. 16/848, filed Apr. 14, 2020, Maziarz.

* cited by examiner
‡ imported from a related application

BEAD STOP FOR A WALL HAVING INTERIOR CEMENT BOARD LAYER

CROSS REFERENCE TO RELATED APPLICATION

This application is a continuation-in-part application of U.S. Utility application Ser. No. 16/751,006 entitled, "Bead Stop for a Wall Having Interior Cement Board Layer" filed Jan. 23, 2020, which itself claims benefit of U.S. Provisional Application Ser. No. 62/947,885 filed Dec. 13, 2019, the entire disclosures of which is incorporated herein by reference.

FIELD OF THE DISCLOSURE

The present disclosure is generally related to stop beads and more particularly is related to stop beads for a wall having an interior cement board layer.

BACKGROUND OF THE DISCLOSURE

In the construction and building industry, stucco, plaster, or similar cement-based materials are commonly used as a wall finishing product to new and existing building. Stucco is generally composed of aggregates, a binder, and water. Once mixed, it is in a wet state and is applied to the exterior sheathing of the building walls. After a period of time, it hardens to a very dense solid where it effectively acts as a durable exterior wall finish for the building.

The specific application of stucco can vary depending on a number of factors, such as the climate and geography of the building, the weather while the stucco is being applied, the finished decorative look of the stucco wall, and others. In virtually all installations, however, the installer first prepares the exterior sheathing of the building. This exterior sheathing layer is commonly composed of plywood, fiberboard, oriented strand board (OSB), or plank lumber which is affixed to the studs of the wall. The installer may then install various stucco accessories, such as weep screeds, expansion and control joints, corner-aids, and architectural reveals. The installer then affixes a wire mesh material, such as wire lath, expanded-metal lath, wove-wire lath, or welded-wire lath, against the exterior sheathing using appropriate fasteners. This wire mesh material provides a structural interfacing material to which the stucco can adhere, such that the stucco is properly retained against the exterior sheathing. The wire mesh material also adds strength to the stucco.

The installation of the stucco generally includes three different layers: first the scratch coat, then the brown coat, and then the finish coat. The scratch coat may consist of plastic cement and sand, or other materials, which is installed against the wire mesh material with a trowel. The scratch coat is generally ⅜ inch to ½ inch thick and envelopes the wire mesh material. Prior to the scratch coat drying, the installer scores the surface with a trowel, scarifier, or similar tool to provide ¼ inch to ⅜ inch deep grooves, which provide an area for the next coat of stucco to adhere to and create a solid bond. The scratch coat must then be left to cure or dry for at least 24 hours, preferably 3-5 days, prior to the next coat.

Once the scratch coat has dried for at least 24 hours, the brown coat can be applied. The brown coat or leveling coat commonly consists of sand, cement, and lime. It is applied to a general thickness of ⅜ inch and is finished to have a leveled, smooth, even exterior surface. This smooth exterior surface is what the finish coat will eventually be applied to. However, before application of the finish coat, the brown coat must dry or cure for a minimum of 7-10 days to allow for shrinkage and/or cracking to occur. After waiting 7-10 days, the installer then returns to the job site to fill in any cracks that have appeared. It is well understood in the industry that waiting 7-10 days for the brown coat to cure is essential to ensuring the stucco wall finish is structurally sound and free from visual defects and imperfections. If the brown coat is not left to cure for 7-10 days and the finish coat is applied prematurely, the stucco wall will be substandard and likely to fail.

After waiting a minimum of 8 days from the initial application of the scratch coat, the final layer of the stucco wall finish may be applied. This final layer is the finish coat, which may include an acrylic finish or a color coat. The finish coat is generally a very thin layer, e.g., ⅛ inch or less, and is applied to the exterior of the cured brown coat. The finish coat may have a decorative finish to it as well as a specific color.

There are a number of complications with installing stucco. First, the time required from start to finish is lengthy and installers must schedule various jobs at various times to ensure that proper cure times are maintained, all while balancing workflow. For example, a stucco installer may have 6 or more stucco projects occurring simultaneously, with each in different stages of application or curing. Another complication caused by the required cure times is that it makes the wall susceptible to damage from the weather. Especially with the brown coat, if rain or other precipitation occurs during the 7-10-day curing period, the moisture will damage the brown coat. If the damage is severe enough, the brown coat will need to be scraped off and reapplied, which is a very laborious and time-consuming process. Recent innovative techniques in stucco application have been developed to help alleviate these complications, but these new methods require new wall accessories and components.

Thus, a heretofore unaddressed need exists in the industry to address the aforementioned deficiencies and inadequacies.

SUMMARY OF THE DISCLOSURE

Embodiments of the present disclosure provide a system for terminating a wall. Briefly described, in architecture, one embodiment of the system, among others, can be implemented as follows. A rigid, cured cement board is attached to exterior sheathing of the wall. A stop bead apparatus is affixed to the rigid, cured cement board. The stop bead apparatus has: a substantially planar base panel; a stop bead wall extending in a substantially perpendicular angle from the base panel; a flexible spacing member extending from a first side of the stop bead wall to a jamb; and a front wall connected to the stop bead wall, the front wall having an exterior edge being the outermost portion of the stop bead apparatus, wherein a gap is formed between the base panel and the exterior sheathing of the wall, wherein an edge of the rigid, cured cement board is positioned with the gap, and wherein cement forming the rigid, cured cement board is cured prior to insertion into the gap. A finish layer is applied to an exterior surface of the rigid, cured cement board, wherein the finish layer covers the base panel of the stop bead apparatus.

The present disclosure can also be viewed as providing methods of constructing a termination point in a wall. In this regard, one embodiment of such a method, among others, can be broadly summarized by the following steps: attaching a rigid, cured cement board to exterior sheathing of the wall; attaching a stop bead apparatus to the rigid, cured cement board along terminating location of the wall, wherein an edge of the rigid, cured cement board is positioned with a gap formed between the exterior sheathing of the wall and the base panel of the stop bead apparatus; and applying a finish layer to an exterior surface of the cement board, whereby the finish layer covers the base panel of the stop bead apparatus.

The present disclosure can also be viewed as providing a stop bead apparatus for use with a stucco wall. Briefly described, in architecture, one embodiment of the apparatus among others, can be implemented as follows. The stop bead apparatus has a substantially planar base panel. A stop bead wall extends in a substantially perpendicular angle from the base panel. A flexible spacing member extends from a first side of the stop bead wall. A front wall is connected to the stop bead wall, the front wall having an exterior edge which forms an outermost portion of the stop bead apparatus. A gap is formed between an interior face of the base panel and a location proximate to an inner, terminating end of the stop bead wall configured to contact or substantially contact exterior sheathing of the stucco or thin veneered stone wall, wherein a rigid, cured cement board is removably insertable into the gap.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1B:
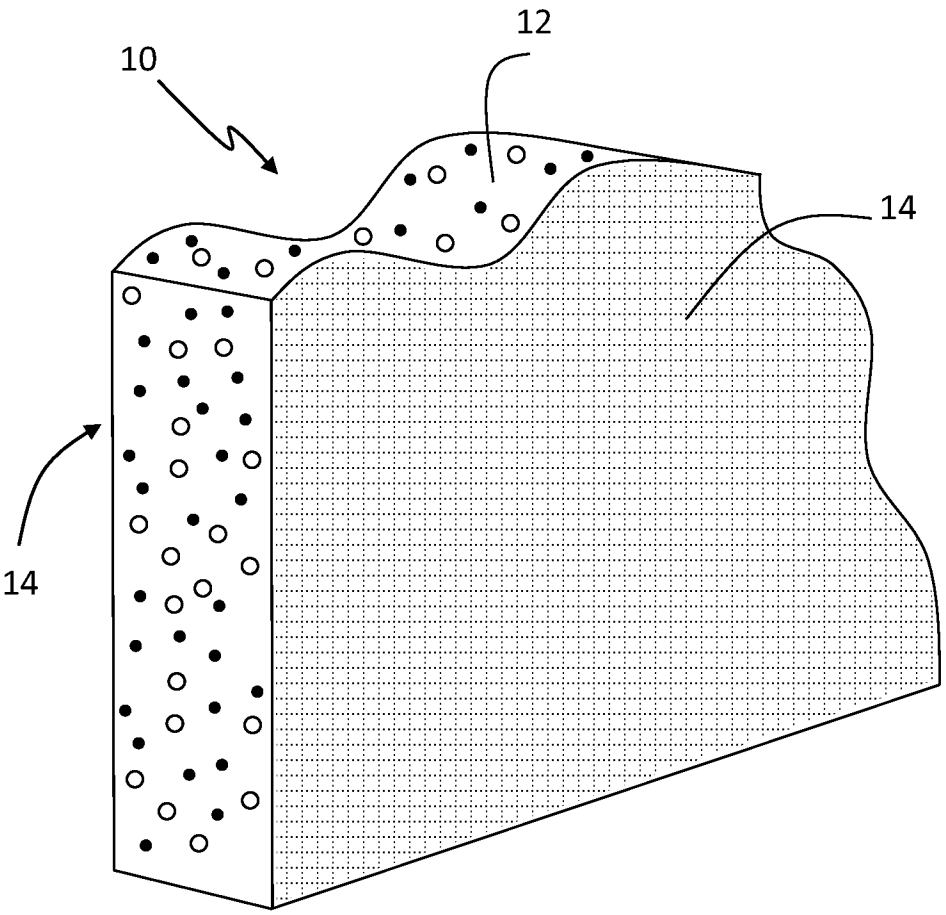
FIG. 1B is a plan view illustration of a rigid cement board, in accordance with the first exemplary embodiment of the present disclosure.
Figure 1A:
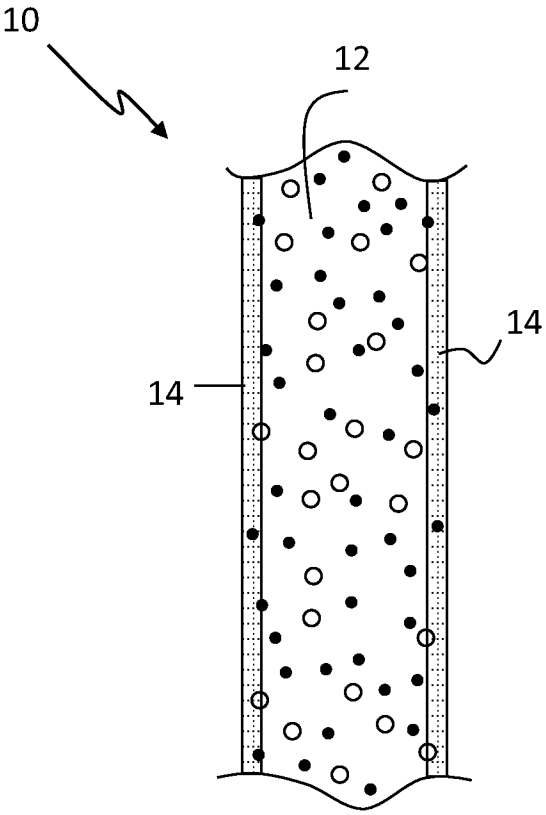
FIG. 1A is a cross-sectional illustration of a rigid cement board, in accordance with a first exemplary embodiment of the present disclosure.

To improve upon the shortcomings of the prior art, as described in the Background, the subject disclosure provides a system for terminating a wall. The wall is constructed with a rigid cement board as an interior layer, replacing scratch layer and effectively replacing the brown layer. FIG. 1A is a cross-sectional illustration of a rigid cement board, in accordance with a first exemplary embodiment of the present disclosure. FIG. 1B is a plan view illustration of a rigid cement board, in accordance with the first exemplary embodiment of the present disclosure. With reference to FIGS. 1A-1B, a cement board 10 is depicted. Cement board 10 is a rigid, cured building material composed of aggregated Portland cement 12 with a glass-fiber mesh 14 on the surfaces. During manufacture of the cement board 10, viscous, uncured cement is mixed with aggregate and other materials, such as fillers, stabilizers, etc., and the mixture is placed in a mold. The mold has glass-fiber mesh 14 or other mesh reinforcements which line the outer surfaces of the cement board 10. The aggregate cement 12 is infused into the mesh 14, as shown in FIG. 1A, such that the aggregate cement 12 and mesh 14 effectively become a unitary structure. The aggregate cement 12 is then cured for a period of time until it is rigid. The cement board 10 may then be cut to shape, which is commonly 3-foot by 5-foot planar sheets which are 0.25 inch thick, 0.5 inch thick, 0.75 inch thick, or another thickness.

To lessen the time it takes to finish the exterior wall of a structure, these rigid cement boards 10 may be used in place of the scratch layer and/or brown layer on conventional stucco or plaster walls. Specifically, the installer may install the cement board 10 directly on the sheathing of the wall, or over another material placed on the sheathing, such as a vapor or moisture barrier. The cement board 10 may be secured with fasteners, such as screws, which affix the cement board to the sheathing. Once the wall is appropriately covered, the installer may then apply a finish coat to the wall, including filling any cracks between the adjacent edges of the cement board 10. Because the cement board 10 is already cured and rigid, the wall does not need to be given time to cure and shrink, as is required with conventional stucco and plaster walls. Thus, it is possible for an installer to effectively install the entirety of a stucco or plaster wall in one single day using cement board 10 versus the 8-15 days required with conventional stucco or plaster walls. This time savings allows the installer to be more efficient and also minimizes the risk of damage to an unfinished wall due to rain or moisture exposure.

Figure 2:
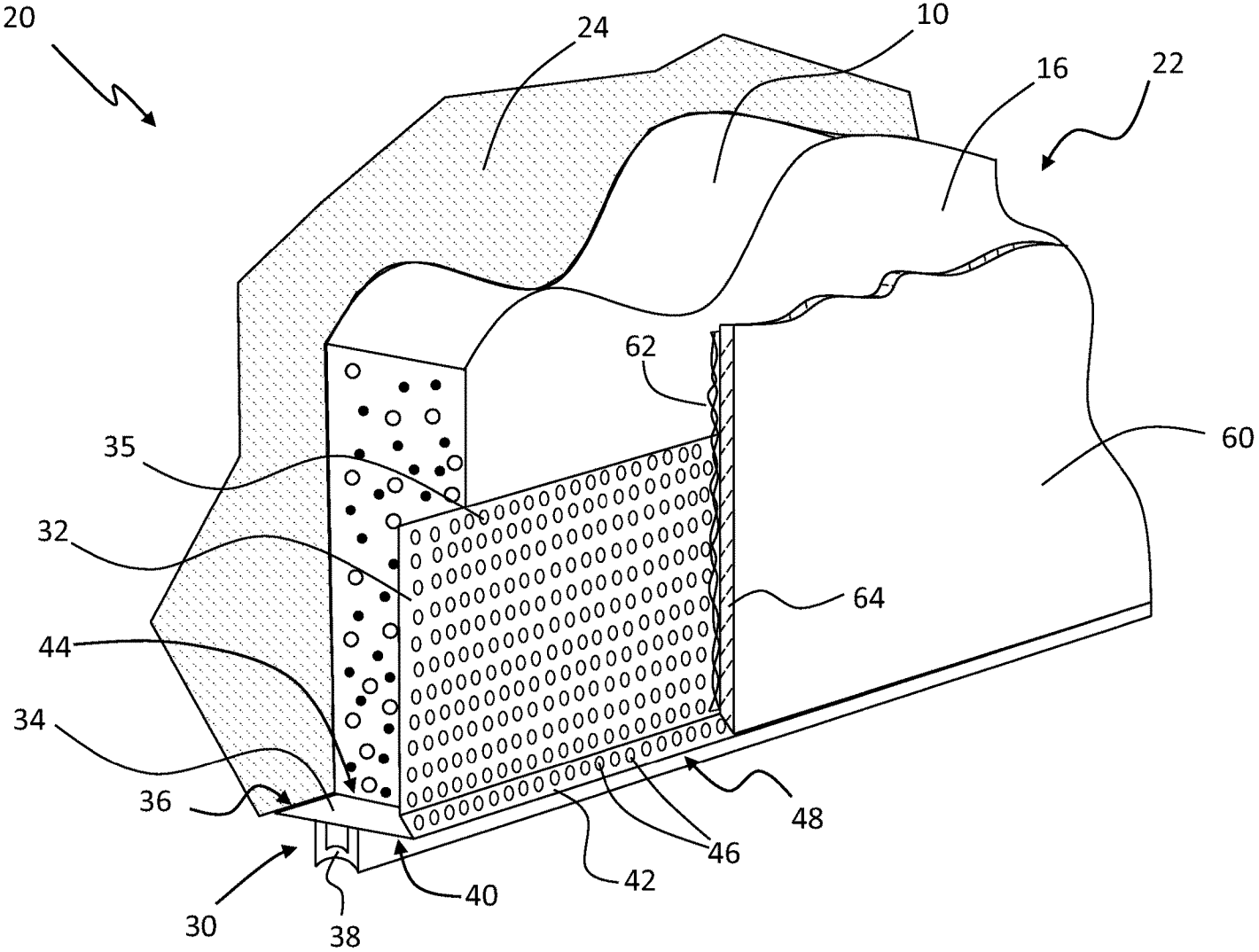
FIG. 2 is a cut-away plan view illustration of a system for terminating a wall using a stop bead apparatus, in accordance with the first exemplary embodiment of the present disclosure.

The subject invention is directed to a system 20 for terminating a wall 22 which uses rigid, cured cement board 10 as an interior layer of the wall's 22 exterior surface. FIG. 2 is a cut-away plan view illustration of a system 20 for terminating a wall using a stop bead apparatus 30, in accordance with the first exemplary embodiment of the present disclosure. With reference to FIG. 2, the wall 22 includes a sheathing layer 24 to which the rigid, cured cement board 10 is affixed. As is known in the industry, the sheathing 24 may include a variety of sheathing materials, such as plywood, OSB, particle board, wood planks, or another sheathing material.

The stop bead apparatus 30 is affixed to the rigid, cured cement board 10, where the stop bead apparatus 30 has a substantially planar base panel 32 which is positioned along the exterior, planar surface of the rigid, cured cement board 10. Unlike most conventional stop bead devices which have a base panel positioned against sheathing 24 of the wall 22, with one side of the base panel abutting the sheathing 24, the base panel 32 of the apparatus 30 has a base panel 32 which is positioned on the exterior of the rigid, cured cement board 10, such that the base panel 32 does not contact the sheathing 24. The base panel 32 may have a height dimension (in a direction away from the stop bead wall 34) which allows it to be positioned substantially along an adequate portion of the cement board 10. For example, the height dimension of the base panel 32 may be larger than a thickness of the stop bead wall 34 or any other structures extending from the stop bead wall 34. In one example, the height dimension of the base panel 32 may be at least 2, 3, 4, or 5 times greater than a width dimension of the stop bead wall 34, as measured between the sheathing 24 and the front wall 42. While the specific dimensions may vary, in one example, the height dimension of the base panel 32 is greater than 1.5 inches, greater than 2 inches, greater than 3 inches, greater than 4 inches, greater than 5 inches, or greater than 10 inches.

The stop bead apparatus 30 may be positioned on the rigid, cured cement board 10, in locations of the wall 22 which abut termination points of the wall 22, commonly at jambs of doors or windows or at other termination locations. In these locations, the stop bead apparatus 30 provides for a termination joint or junction within the wall to the jamb or other structure. The stop bead apparatus 30, and any components thereof, may be constructed from extrusion, molding or other manufacturing technique using plastic, vinyl, metal, metal compounds, fiber glass, or other materials.

The stop bead apparatus 30 includes a stop bead wall 34 extending in a substantially perpendicular angle from the base panel 32 along a first edge 36 of the base panel 32. The first edge 36 may be in contact with the sheathing 24 of the wall 22, such that the stop bead wall 34 extends in substantially a perpendicular direction extending outwards from the plane of the wall sheathing 24, whereby it has an interior side which can contact the cement board 10 and an exterior side that faces towards the jamb of the door or window. In one example, only an interior surface of the stop bead wall 34 at the first edge 36 contacts the sheathing 24 of the wall 22. A flexible spacing member 38 extends from a first side 40 (exterior side) of the stop bead wall 34 to a jamb (FIGS. 3B, 4B, 5B, 6B, and 7-8). This spacing member 38 may be resilient and flexible, such that the stop bead apparatus 30 can be positioned with the pointed tip or tips of the spacing member 38 against the jamb. During contractions and expansions of the building materials due to weather or temperature changes, the spacing member 38 maintains a tight bond with the jamb, thereby preventing moisture, air, insects, or other materials from gaining access to the interior of the structure through the wall 22 at this location. As shown in the figures, the spacing member 38 may be a structure which is integrally molded to the stop bead wall 34, with a concave shape such that when the spacing member 38 contacts the jamb 26, it slightly deforms to seal against the jamb 26. In other examples, the spacing member 38 may be formed from closed or open cell foam, a rubberized material, or similar material which is capable of sealing against the jamb 26.

The stop bead apparatus 30 also has a front wall 42 which is connected to the stop bead wall 34. The front wall 42 may have a variety of shapes and positions. As shown in FIG. 2, the front wall 42 may generally extend in a direction substantially opposite the first side of the stop bead wall 34, e.g., such that it extends away from the spacing member 38. As shown in FIG. 2, the front wall 42 may be connected to the base panel 32, such that the front wall 42 is formed as a portion of the base panel 32. In other designs, the base panel 32 may be connected to the stop bead wall 34 with the front wall 42 positioned in a forward or exterior area of the connection between the stop bead wall 34 and the base panel 32. The front wall 42 may extend in a direction away from the stop bead wall 34 a predetermined distance from the stop bead wall 34 to form a gap 44 between the wall sheathing 24 and the front wall 42, whereby the rigid, cured cement board 10 is received within this gap 44. Thus, the rigid, cured cement board 10 is positionable between the interior face of the base panel 32 and the exterior surface of sheathing 24 of the wall 22.

As is shown in FIG. 2, the rigid cement board 10 can be positioned within the gap 44. Depending on the design of the system 20, the size of the front wall 42 and gap 44 may vary, but it may be preferred for the size of the gap 44 to be the same size as a thickness measurement of the rigid, cured cement board 10, or more preferred, to be a smaller size of the thickness measurement of the rigid, cured cement board 10. In this way, when the stop bead apparatus 30 is positioned against the rigid, cured cement board 10, the base panel 32 can sit substantially flush and in planar abutment with the exterior face of the rigid, cement board 10. In this position, one planar face of the cement board 10, i.e., the interior face, may be positioned abutting the sheathing 24 while the other planar face of the cement board 10, i.e., the exterior face 16, is positioned abutting the base panel 32, facing outwards away from the wall 22.

Since the cement used to form the rigid cement board 10 is cured at a factory or other venue prior to insertion into the gap 44, the rigid cement board 10 can be first installed with appropriate fasteners to the wall sheathing 24. For instance, the installer may cover the sheathing 24 of the wall 22 with a plurality of cement boards 10, thereby constructing a base or interior layer of the exterior surface of the wall 22. Once the rigid cement board 10 is appropriately positioned on the sheathing 24, it may be fastened to the sheathing 24 with a screw, nail, or other fastener (not shown). This fastener structurally retains the cement board 10 to the sheathing 24. Then, once the rigid, cured cement board 10 is affixed to the wall sheathing 24, the stop bead apparatus 30 can be installed with the base panel 32 positioned against the exterior surface 16 of the cement board 10 in locations around a jamb, and with the stop bead wall 34 substantially in contact with the terminating end of the rigid, cured cement board 10. The installer may use one or more fasteners to retain the stop bead apparatus 30 to the cement board 10, or the installer may use a quantity of cementitious material, such as the same material used with a finish layer 60, to temporarily hold the stop bead apparatus 30 in place until the finished layer 60 is completed.

After the cement board 10 is installed on a wall 22 surface and the stop bead apparatus 30 is installed against the cement board 10, the installer may then apply a finish layer 60 to the exterior face 16 of the rigid cement board 10. The finish layer 60 may include a variety of different materials and/or techniques, depending on the design of the wall. For example, it may be common for the installer to fill in any gaps between the edges of the cement boards 10 and then apply the finish layer. This may include first applying a wire mesh 62 which is fastened to the cement board 10. To the wire mesh 62, a finish coat 64 of stucco and/or plaster may then be applied, where the stucco and/or plaster material impregnates the wire mesh 62, which effectively holds it to the cement board 10. Additionally, the finish coat 60 can impregnate a plurality of holes or apertures 35 within the base panel 32, such that the base panel 32 is secured in place with the wire mesh 62 against the cement board 10. In other examples of the finish layer 60, the finish layer 60 may include other materials or techniques. For example, the installer may still install a brown coat, but the thickness of the brown coat may be substantially less than that of conventional stucco or plaster walls, such that the drying or curing time may be far less than the conventional time of 7-10 days. The finish layer 60 may also include other materials beyond plaster or stucco, such as thin veneered stone, or other natural or artificial stone materials which can be applied to the wall as the finish layer 60.

Regardless of how the finish layer 60 is applied, the edge of the finish layer 60 may be interfaced with at least a portion of the front wall 42 of the stop bead apparatus 30, thereby allowing the installer to achieve clean, event termination edges of the finish layer 60. For instance, the finish layer 60 may be troweled to be substantially the same height as the terminating end of the front wall 42, such that the front wall 42 acts as a guide for application of the finish layer 60, both for the thickness of the finish layer 60 and to provide a clean, durable edge for termination of the wall 22 at the location of the jamb.

It is noted that the front wall 42 may include one or a plurality of features 46, such as holes, grooves, channels, or similar structural features, which catch the stucco or plaster material used in the finish layer 60, thereby securing, holding, or catching the edge of the finish layer 60. This may prevent the edge of the finish layer 60 from falling off the wall 22. These same features 46 may also be included or used with the stop bead wall 32 to increase the structural durability of the stop bead apparatus 30 and ensure a strong connection to the cement board 10. Additionally, the installer may install the finish layer 60 up to an exterior point 48 of the front wall 42, which effectively acts as a finish edge for the finish layer 60. This exterior point 48 which can be used to create a finish edge may have a variety of different shapes and dimensions, such as depicted relative to FIGS. 3A-6B.

Figure 3B:
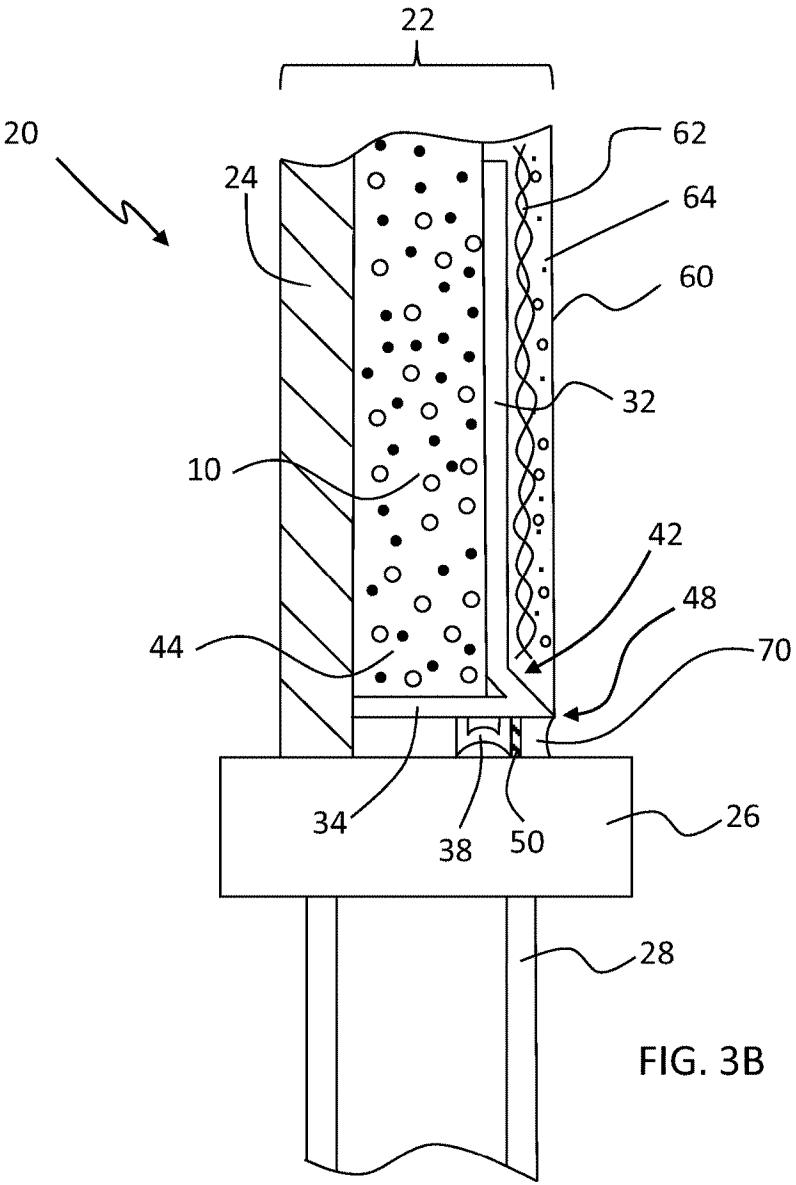
FIGS. 3A-3B are cross-sectional side view illustrations of a system for terminating a wall using a stop bead apparatus, in accordance with the first exemplary embodiment of the present disclosure.
Figure 3A:
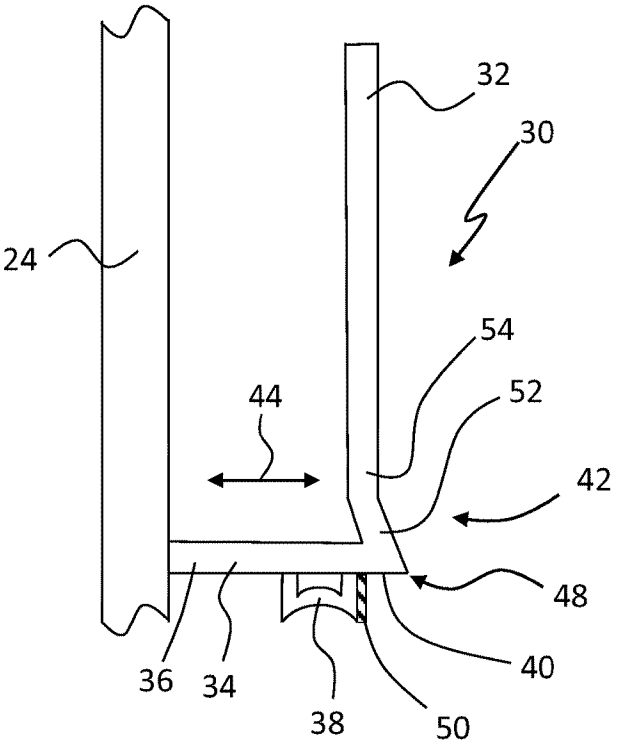

FIGS. 3A-6B are cross-sectional side view illustrations of a system for terminating a wall using a stop bead apparatus, in accordance with the first exemplary embodiment of the present disclosure. In particular, FIGS. 3A-6B depict various types of stop bead apparatuses 30 which can be used with a wall. Referring first to FIGS. 3A-3B, the stop bead apparatus 30 is depicted both alone (FIG. 3A) and in a finished wall (FIG. 3B). The rigid, cured cement board 10 is positioned against the sheathing 24 with the stop bead wall 34 positioned in abutment with a terminating end of the cement board 10. In this position, the spacing member 38 is positioned proximate to the jamb 26 of a window 28, such that the spacing member 38 contacts the edge of the jamb 26. The base panel 32 of the stop bead apparatus 30 is positioned against an exterior face of the cement board 10, such that the cement board 10 is located in the gap 44 formed between the base panel 32 and the sheathing 24. On the exterior of the cement board 10 and the base panel 32 is the finish layer 60, which in this example, includes a wire mesh 62 and a finish coat 64 of stucco or plaster. The finish layer 60 terminates along the front wall 42, where the pointed exterior edge 48 is used to form the finish edge in the finish layer 60. As shown, the exterior edge 48 may be the outermost structure of the stop bead apparatus 30, which allows the installer to achieve a clean termination of the stucco or plaster wall. A quantity of caulking 70 may be positioned between the stop bead wall 34 and the jamb 26 and exterior of the spacing member 38, which allows for a seamless interface from the jam 26 to the wall 22. A bond-breaking tape 50 may be used between the caulking 70 and the spacing member 38, which allows for easy removal of the caulking 70.

As can be seen in FIGS. 3A-3B, the front wall 42 of the stop bead apparatus 30 includes first and second connected wall portions, 52, 54 which have different angular positions. The first wall portion 52 extends from the stop bead wall 34 at an acute angle relative to the stop bead wall 34, i.e., as measured between the surfaces of the stop bead wall 34 and first wall portion 52 forming the lower end of the gap 44. The second wall portion 54 may be the lower portion of the base panel 32, which is connected to the first wall portion 52 and is positioned substantially parallel to the wall sheathing 24. As can be seen, the combination of the first and second wall portions 52, 54 allows for the front wall 42 to have a pointed exterior edge 48 in the first wall portion 52, while allowing for adequate space for placing the finish layer 60 over the base panel 32 and the second wall portion 54, as well as part of the first wall portion 52. The front wall 42 may include one or a plurality of features, such as holes, grooves, channels, or similar structural features, as shown in FIG. 2, which catch the stucco or plaster material used in the finish layer 60, thereby securing, holding, or catching the edge of the finish layer 60.

While the dimensions of the structure may vary, in one example the base panel 32 is 1.75 inches and the front wall 42 is approximately 0.75 inches in length with the first wall portion 52 being approximately 0.25 inches. The angular position of the first wall portion 52 may extend back towards the base panel 32 approximately 0.125 inches. The gap 44 may be approximately 0.5 inches or less, such that it is sized to receive a cement board 10 having a 0.5 inch thickness. For cement board 10 having other thicknesses, the gap 44 may be sized differently. Also, the space of the gap 44 may be slightly smaller than the thickness of the intended cement board 10, such that when the base panel 32 is abutting the planar surface of the cement board 10, the inner, terminating end of the stop bead wall 34 is slightly spaced from contact with the sheathing 24. In this way, it is possible to ensure the base panel 32 remains in a flush, fully contacted position with the cement board 10, thereby creating a tight joint.

Figure 4B:
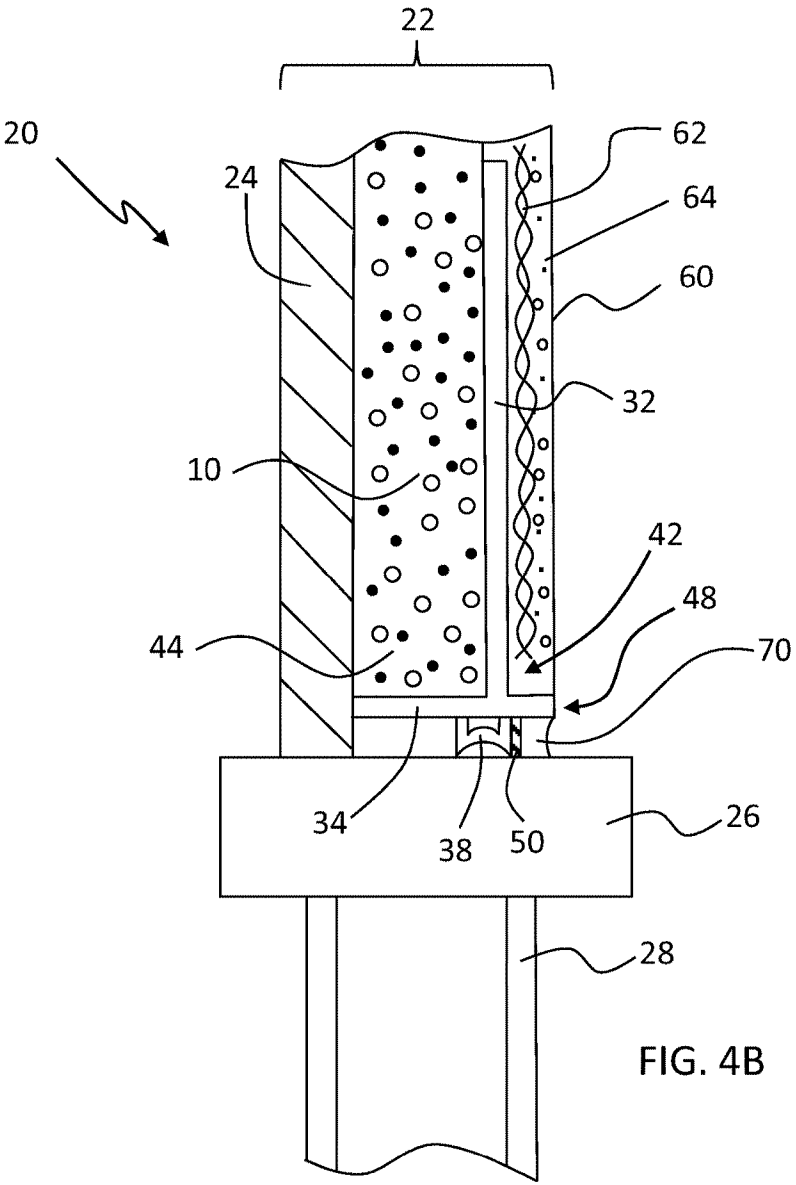
FIGS. 4A-4B are cross-sectional side view illustrations of a system for terminating a wall using a stop bead apparatus, in accordance with the first exemplary embodiment of the present disclosure.
Figure 4A:
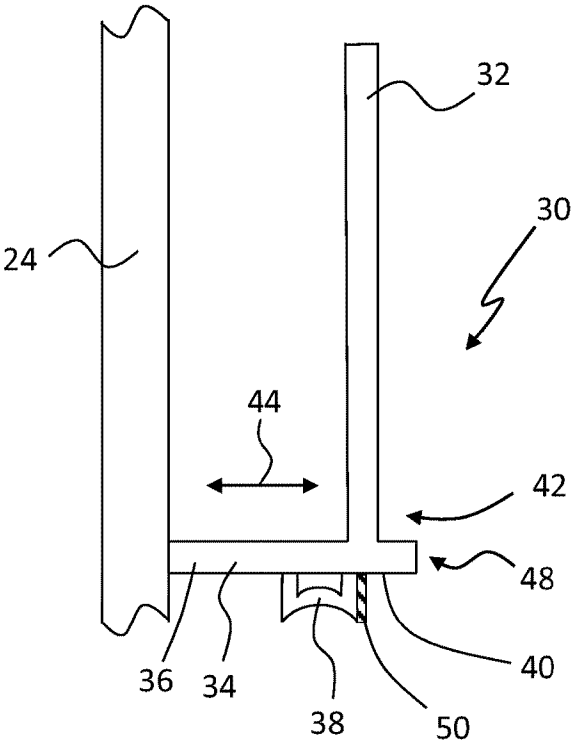

FIGS. 4A-4B illustrate a variation of the front wall 42 design of the stop bead apparatus 30, which apart from the front wall 42, contains all of the features and structures discussed relative to FIGS. 3A-3B. For brevity in disclosure, reference is made to the description relative to FIGS. 3A-3B for these common features. Regarding the front wall 42, as can be seen in FIGS. 4A-4B, the front wall 42 is formed as the lower part of the base panel 32, such that the front wall 42 and base panel 32 extend from the stop bead wall 34 in a substantially perpendicular angle to the stop bead wall 34. The combined base panel 32 and front wall 42 may be formed as a single, unitary wall portion which is set back from a terminating edge of the stop bead wall 34. This terminating edge of the stop bead wall 34 forms exterior edge 48 of the stop bead apparatus 30, while the set-back position of the base panel 32 and front wall 42 allow for adequate space for the finish layer 60 to be applied. The base panel 32 and front wall 42 may include one or a plurality of features, such as holes, grooves, channels, or similar structural features, as shown in FIG. 2, which catch the stucco or plaster material used in the finish layer 60, thereby securing, holding, or catching the edge of the finish layer 60. While the dimensions may vary, the front wall may be set back approximately 0.125 to 0.25 inches.

Figure 5B:
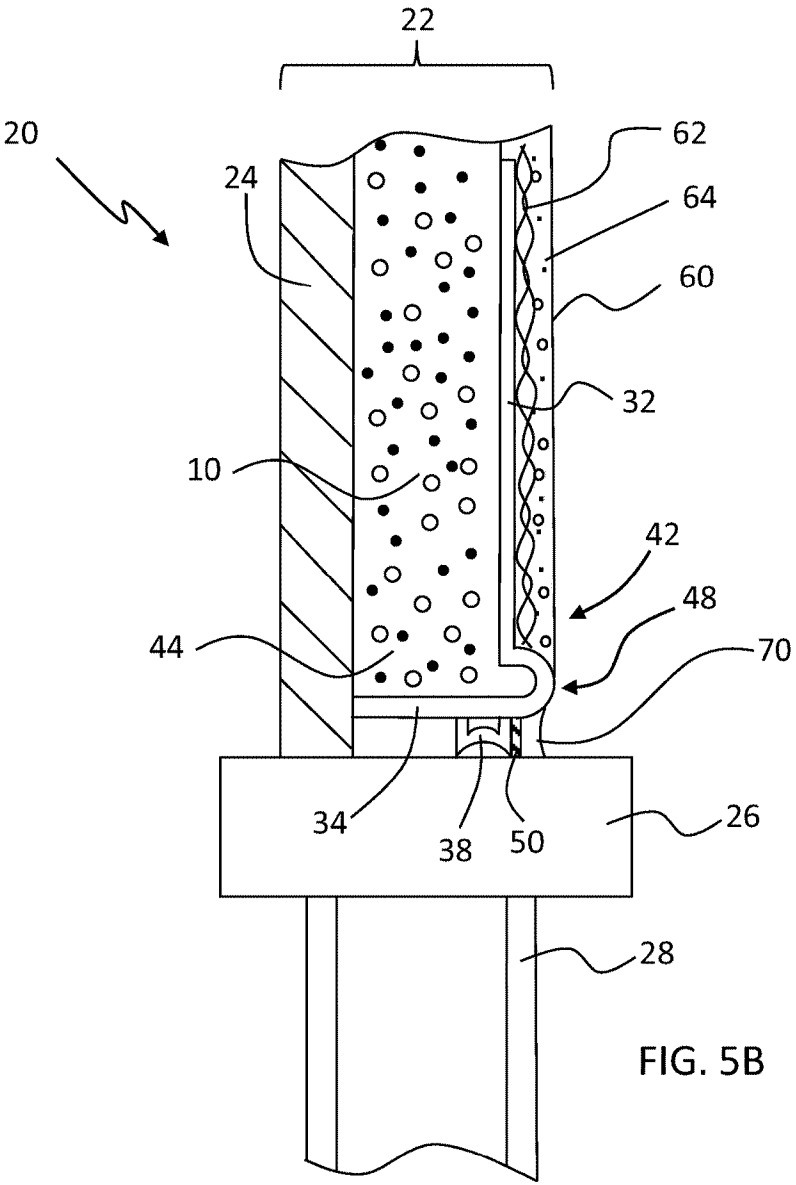
FIGS. 5A-5B are cross-sectional side view illustrations of a system for terminating a wall using a stop bead apparatus, in accordance with the first exemplary embodiment of the present disclosure.
Figure 5A:
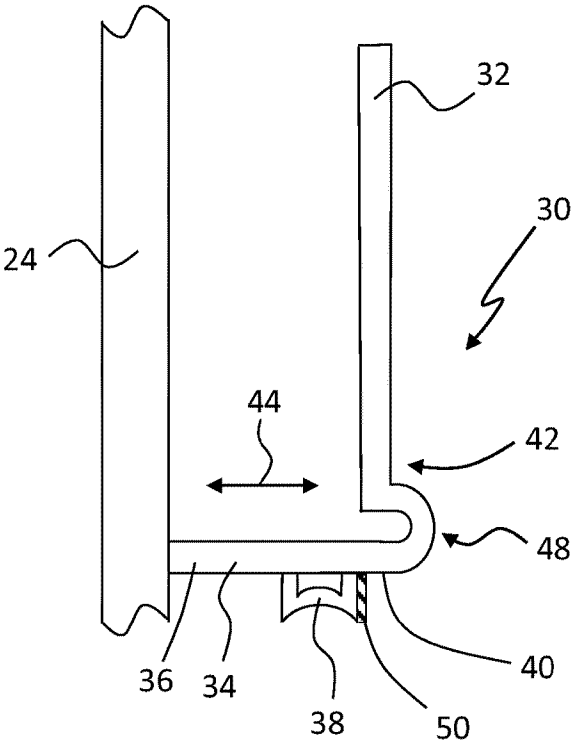

FIGS. 5A-5B illustrate another variation of the exterior edge 48 design of the stop bead apparatus 30, which apart from the exterior edge 48 shape, contains all of the features and structures discussed relative to FIGS. 3A-3B. For brevity in disclosure, reference is made to the description relative to FIGS. 3A-3B for these common features. Regarding the exterior edge 48, as can be seen in FIGS. 5A-5B, the exterior edge 48 has a curved portion extending from the stop bead wall 34 and extending back in a direction towards the base panel 32 in a U-shape. The curved portion may be integrally formed with the end of the stop bead wall 34 and the base panel 32, where the front wall 42 connects to the base panel 32. The exterior edge 48 is formed at an outermost location of the stop bead apparatus 30, such that the exterior-most point of the curved portion forms the exterior edge 48. The return or turned-back part of the curved portion may be connected to a front wall 42 and base panel 32 which are substantially linear and extend in a direction parallel to the wall sheathing 24. The set-back location of the base panel 32 allows for adequate space for the finish layer 60 to be applied. The front wall 42 and base panel 32 may include one or a plurality of features, such as holes, grooves, channels, or similar structural features, as shown in FIG. 2, which catch the stucco or plaster material used in the finish layer 60, thereby securing, holding, or catching the edge of the finish layer 60. While the dimensions may vary, the front wall may be set back approximately 0.125 to 0.25 inches.

Figure 6B:
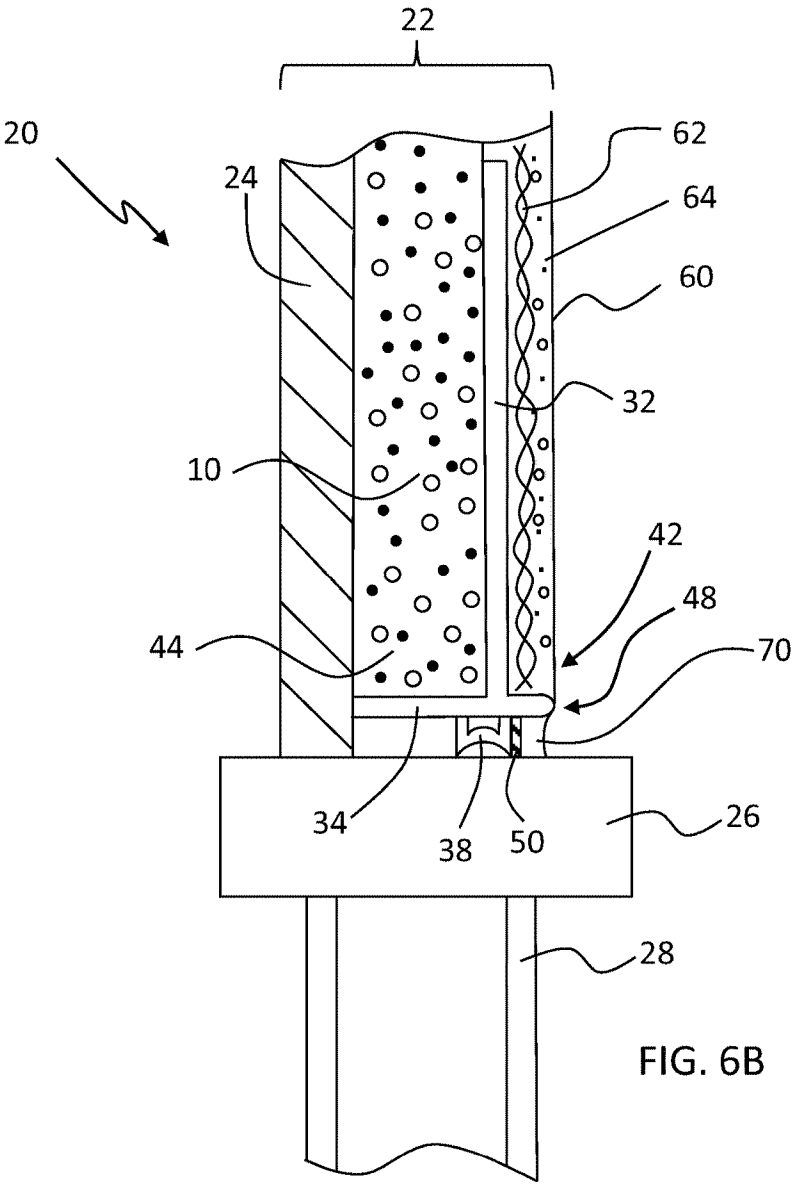
FIGS. 6A-6B are cross-sectional side view illustrations of a system for terminating a wall using a stop bead apparatus, in accordance with the first exemplary embodiment of the present disclosure.
Figure 6A:
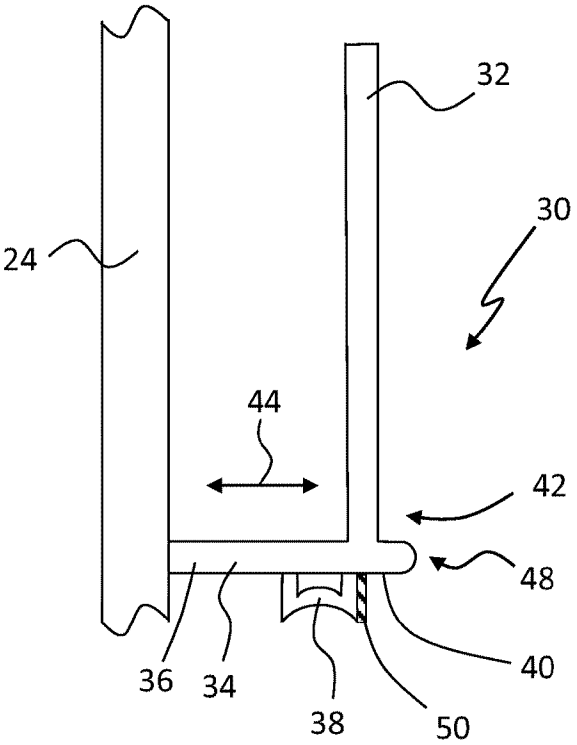

FIGS. 6A-6B illustrate another variation of the exterior edge 48 design of the stop bead apparatus 30, which apart from the exterior edge 48, contains all of the features and structures discussed relative to FIGS. 3A-3B. For brevity in disclosure, reference is made to the description relative to FIGS. 3A-3B for these common features. Regarding the exterior edge 48, as can be seen in FIGS. 6A-6B, exterior edge 48 is formed as a single protrusion with a rounded edge. The single protrusion may be an extension of the stop bead wall 34 which extends past the base panel 32 and terminates in a rounded edge having a curvilinear shape, such that the upper and lower surfaces of the exterior edge 48 are substantially interconnected without sharp joints or sharp edges. The set-back location of the base panel 32 may allow for adequate space for the finish layer 60 to be applied. The front wall 42 and base panel 32 may include one or a plurality of features, such as holes, grooves, channels, or similar structural features, as shown in FIG. 2, which catch the stucco or plaster material used in the finish layer 60, thereby securing, holding, or catching the edge of the finish layer 60. While the dimensions may vary, the base panel 32 and the front wall 42 may be set back approximately 0.125 to 0.25 inches.

Figure 7:
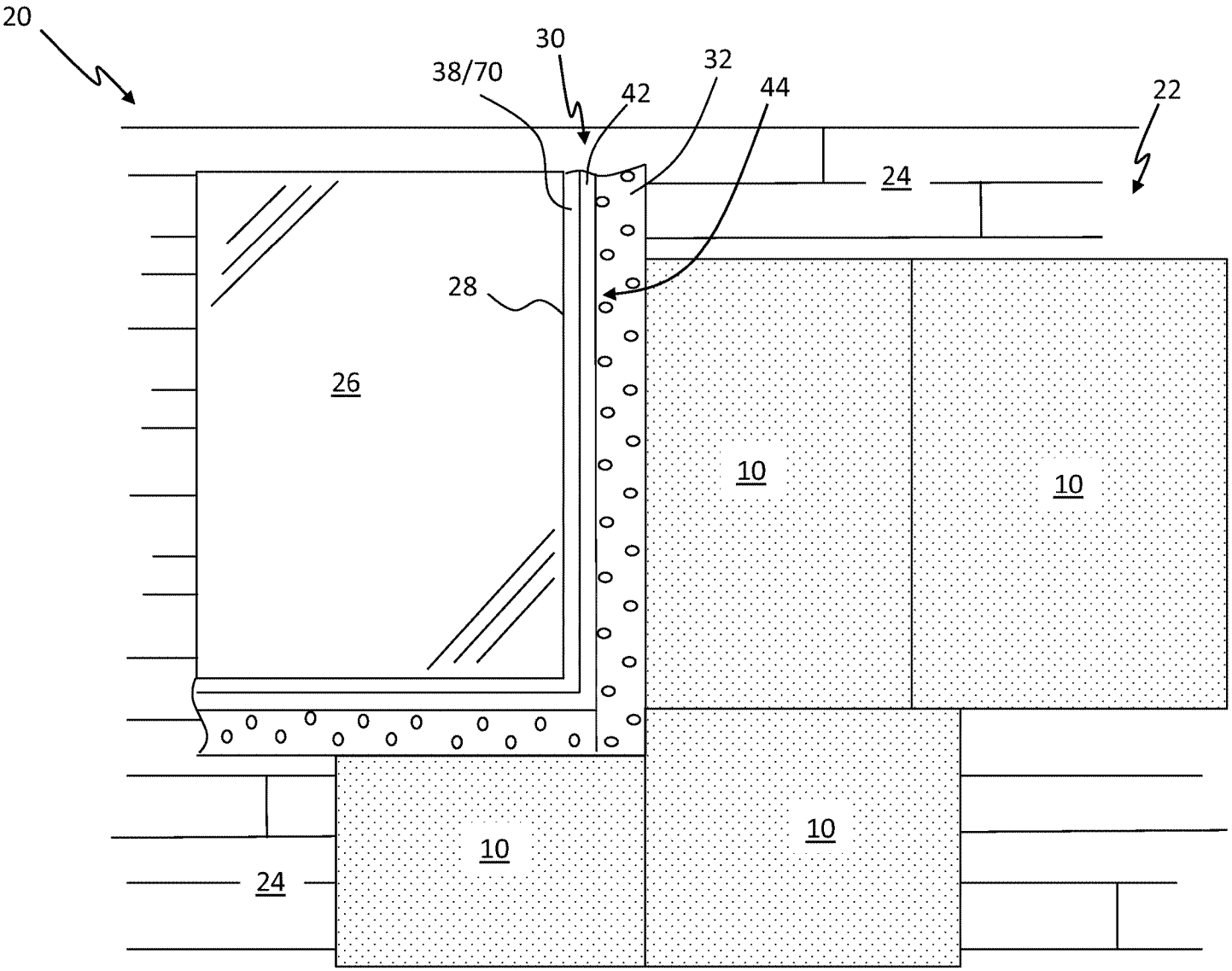
FIG. 7 is a cut-away front view illustration of a wall with a system for terminating the wall using a stop bead apparatus, in accordance with the first exemplary embodiment of the present disclosure.
Figure 8:
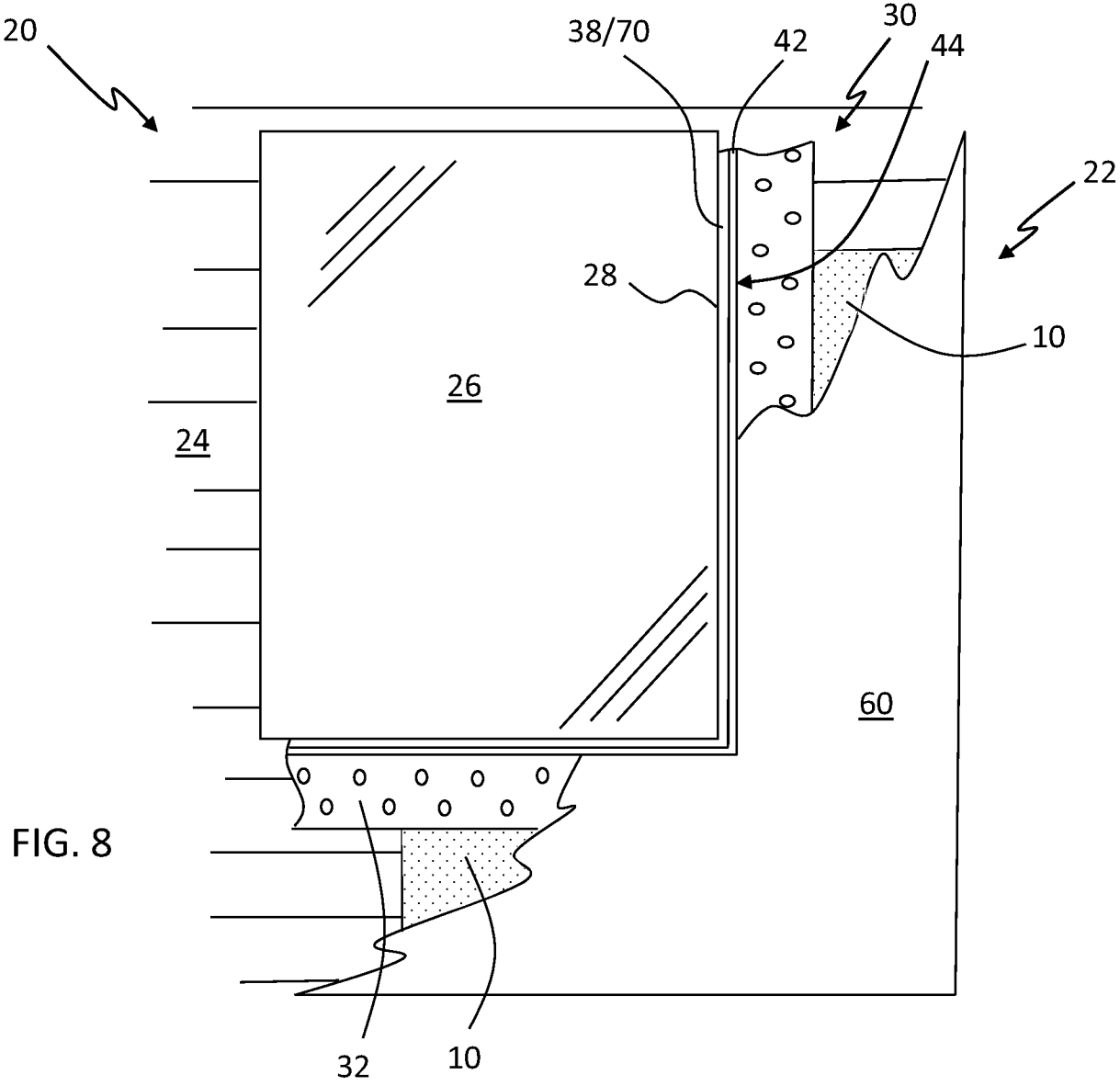
FIG. 8 is a detailed cut-away front view illustration of a wall with a system for terminating the wall using a stop bead apparatus of FIG. 7, in accordance with the first exemplary embodiment of the present disclosure.

FIG. 7 is a cut-away front view illustration of a wall with a system for terminating the wall using a stop bead apparatus, in accordance with the first exemplary embodiment of the present disclosure. FIG. 8 is a detailed cut-away front view illustration of a wall with a system for terminating the wall using a stop bead apparatus of FIG. 7, in accordance with the first exemplary embodiment of the present disclosure. Referring to FIGS. 7-8, an example of the overall wall 22 construction can be seen. Here, a window 28 with a jamb 26 is constructed in a wall 22. The wall 22 has sheathing 24 which is positioned over the framework of the wall 22. To terminate the wall 22 at the jamb 26, the stop bead apparatus 30 may be used, where the stop bead apparatus 30 is attached to the rigid, cured cement board 10, which itself is attached to the sheathing 24 around the jamb 26, such that the spacing member 38 and caulked joint 70 abut the jamb 26. As shown, a plurality of rigid cement boards 10 may be positioned attached to the sheathing 24 of the wall 22, where the cement boards 10 abutting the jamb 26 are positioned with their edges in the gap 44 formed interior of the base panel 32 of the stop bead apparatus 30. In this position, as shown in FIG. 7, the edge portions of the cement board 10 which abut the window 26 are covered by the base panel 32 of the stop bead apparatus 30. During installation, once the cement boards 10 are appropriately affixed to the sheathing 24 of the wall 22, the stop bead apparatus 30 may be applied around the windows 28 or similar features in the wall, and then the finish layer 60 may be installed over them, as shown in FIG. 8.

Figure 9:
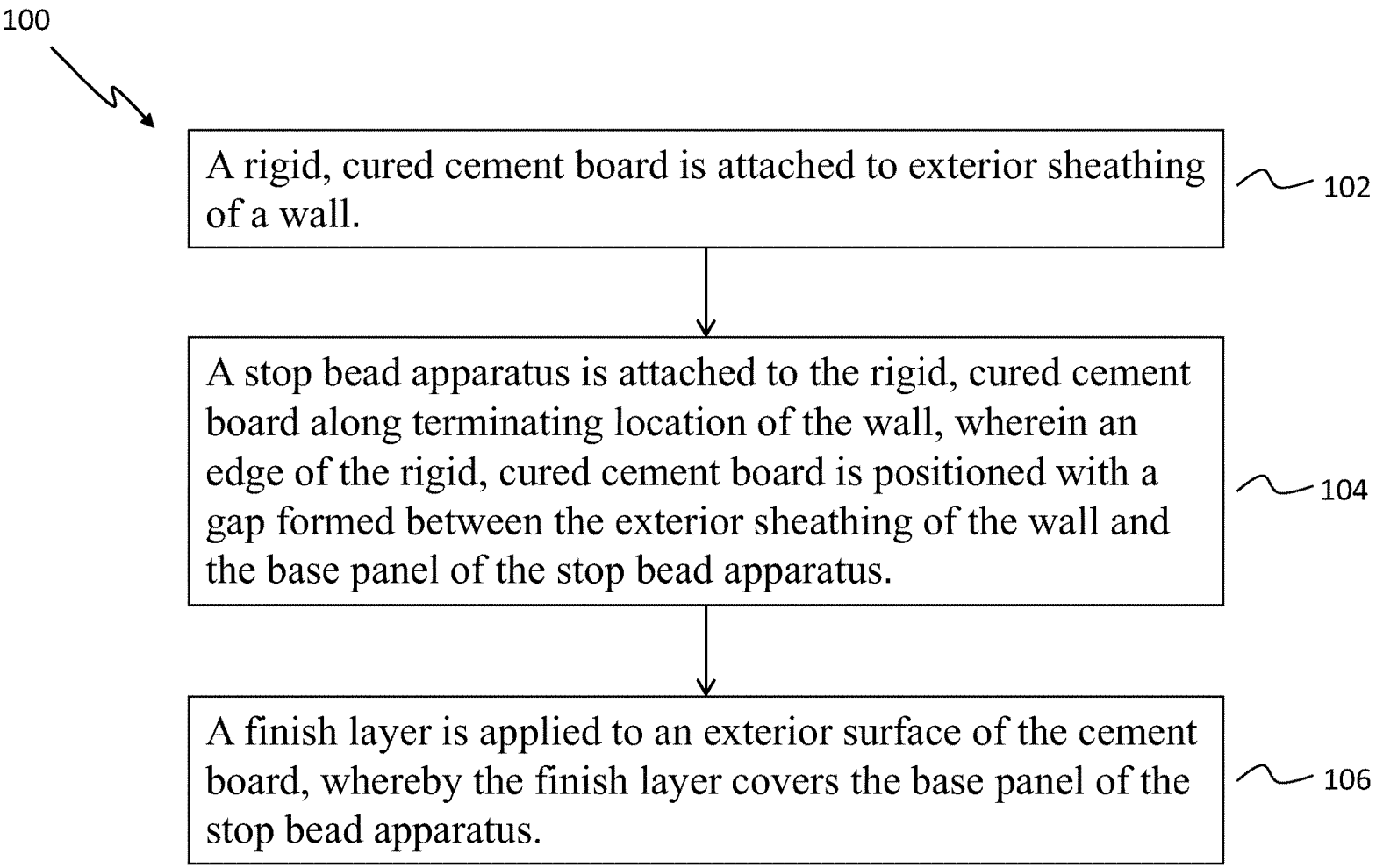
FIG. 9 is a flowchart illustrating a method for constructing a termination point in a wall, in accordance with the first exemplary embodiment of the disclosure.

FIG. 9 is a flowchart 100 illustrating a method for constructing a termination point in a wall 22, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a rigid, cured cement board is attached to exterior sheathing of a wall. A stop bead apparatus is attached to the rigid, cured cement board along terminating location of the wall, wherein an edge of the rigid, cured cement board is positioned with a gap formed between the exterior sheathing of the wall and the base panel of the stop bead apparatus (block 104). A finish layer is applied to an exterior surface of the cement board, whereby the finish layer covers the base panel of the stop bead apparatus (block 106).

As discussed previously, this method may save considerable time to installers of stucco or plaster walls by using cement boards which are cured and rigid, as opposed to scratch layers applied on-site. The stop bead apparatus may further enhance the time savings by allowing installers to easily and efficiently terminate the wall at a jamb or other structure, all while ensuring that the wall termination is durable and high-quality. It is noted that the method may include any number of additional steps, variations, or functions beyond those illustrated in FIG. 9, where the additional steps, variations, or functions may include any disclosed relative to FIGS. 1-8 herein, all of which serve as a portion of the disclosure of the method of FIG. 9.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A stop bead apparatus at a termination point in a wall at a location against a jamb of a door or window in a stucco or thin veneered stone wall with a rigid cured cement board backing, the stop bead apparatus comprising:

a substantially planar base panel;

a stop bead wall extending in a fixed, substantially perpendicular angle from the base panel, the stop bead wall being free from holes or openings and being positioned substantially parallel to the jamb;

a flexible spacing member extending from a first side of the stop bead wall, wherein the flexible spacing member is compressed against the jamb thereby maintaining a tight bond against the jamb;

a front wall connected to the stop bead wall, the front wall having an exterior edge which forms an outermost portion of the stop bead apparatus; and a gap formed between an interior face of the base panel and a location proximate to an inner, terminating end of the stop bead wall, wherein a dimension of an entire length of the stop bead wall between an interior face of the base panel and exterior sheathing of the stucco or thin veneered stone wall is less than a thickness of the rigid, cured cement board such that the inner surface of the base panel remains in a contacted position with the exterior surface of the rigid, cured cement board, wherein a terminating edge of a rigid, cured cement board is removably insertable into the gap, wherein the terminating edge of the rigid, cured cement board is positioned between the exterior sheathing and the base panel.

2. The stop bead apparatus of claim 1, wherein a finish layer of the stucco or a mortar of the thin veneered stone is applied over the rigid, cured cement board and the base panel, whereby the finish layer of the stucco or the mortar of the thin veneered stone contacts and at least partially embeds into at least one aperture of the base panel.

3. A system for terminating a wall at a location against a jamb of a door or window, the system comprising:

a rigid, cured cement board attached to exterior sheathing of the wall;

a stop bead apparatus affixed to the rigid, cured cement board proximate to the jamb of a door or window, the stop bead apparatus having:

a substantially planar base panel;

a stop bead wall extending in a fixed, substantially perpendicular angle from the base panel, the stop bead wall being free from holes or openings and being positioned substantially parallel to the jamb;

a flexible spacing member extending from a first side of the stop bead wall to the jamb, wherein the flexible spacing member is compressed against the jamb thereby maintaining a tight bond against the jamb; and a front wall connected to the stop bead wall, the front wall having an exterior edge being the outermost portion of the stop bead apparatus, wherein a gap is formed between the base panel and the exterior sheathing of the wall, wherein a terminating edge of the rigid, cured cement board is positioned with the gap such that the terminating edge of the rigid, cured cement board is positioned between the exterior sheathing and the base panel, wherein a dimension of an entire length of the stop bead wall between an interior surface of the base panel and the exterior sheathing of the wall is less than a thickness of the rigid, cured cement board such that the inner surface of the base panel remains in a contacted position with the exterior surface of the rigid, cured cement board, and wherein cement forming the rigid, cured cement board is cured prior to insertion into the gap; and a finish layer applied to an exterior surface of the rigid, cured cement board, wherein the finish layer covers the base panel of the stop bead apparatus.

4. The system of claim 3, further comprising a caulked joint between the stop bead apparatus and the jamb.

5. The system of claim 4, further comprising a bond-breaking tape positioned between an exterior surface of the spacing member and the caulked joint between the stop bead apparatus and the jamb.

6. The system of claim 3, wherein a terminating edge of the finish layer is secured to at least a portion of the front wall and the base panel of the stop bead apparatus.

7. The system of claim 3, wherein the exterior edge further comprises one of:

a pointed terminating end of the stop bead wall;

a terminating end of the stop bead wall, the terminating end having substantially right angles;

a curved terminating end of the stop bead wall, the curved terminating end extending back towards the base panel; or a terminating end of the stop bead wall, the terminating end having a rounded edge with a curvilinear shape.

8. A method for constructing a termination point in a wall at a location against a jamb of a door or window, the method comprising the steps of:

attaching a rigid, cured cement board to exterior sheathing of the wall;

attaching a stop bead apparatus to the rigid, cured cement board along a terminating location of the wall proximate to a jamb of a door or window, the stop bead apparatus having a flexible spacing member mounted to a stop bead wall, the stop bead wall extending in a fixed, substantially perpendicular angle from a base panel and being free from holes or openings and being positioned substantially parallel to the jamb, wherein the flexible spacing member is compressed against the jamb thereby maintaining a tight bond against the jamb, wherein a terminating edge of the rigid, cured cement board is positioned with a gap formed between the exterior sheathing of the wall and the base panel of the stop bead apparatus, and wherein a dimension of an entire length of the stop bead wall between an interior surface of the base panel and the exterior sheathing of the wall is less than a thickness of the rigid, cured cement board such that the inner surface of the base panel remains in a contacted position with the exterior surface of the rigid, cured cement board; and applying a finish layer to an exterior surface of the cement board, whereby the finish layer covers the base panel of the stop bead apparatus.

9. The method of claim 8, further comprising the step of caulking a joint between the stop bead apparatus and the jamb.

10. The method of claim 9, further comprising a bond-breaking tape positioned between an exterior surface of the spacing member and the caulking within the joint between the stop bead apparatus and the jamb.

11. The method of claim 8, wherein applying the finish layer to the exterior surface of the cement board further comprises securing a terminating edge of the finish layer to at least a portion of a front wall of the stop bead apparatus.

12. The method of claim 8, wherein a front wall of the stop bead apparatus comprises an exterior edge, the exterior edge being an outermost portion of the stop bead apparatus, whereby the base panel is positioned inset relative to the exterior edge such that the finish layer formed over the base panel is substantially flush with the exterior edge.

13. The method of claim 12, wherein the exterior edge further comprises one of:

a pointed terminating end of the stop bead wall;

a terminating end of the stop bead wall, the terminating end having substantially right angles;

a curved terminating end of the stop bead wall, the curved terminating end extending back towards the base panel; or a terminating end of the stop bead wall, the terminating end having a rounded edge with a curvilinear shape.

* * * * *